United States Patent [19]

Lee et al.

[11] 4,130,498

[45] Dec. 19, 1978

[54] DETERGENT COMPOSITIONS

[75] Inventors: Frank Lee, Bolton; James Allan, Cheadle; Charles Fearnley, Romiley, all of England

[73] Assignee: Ciba-Geigy AG, Basel, Switzerland

[21] Appl. No.: 723,118

[22] Filed: Sep. 14, 1976

[30] Foreign Application Priority Data

Sep. 17, 1975 [GB] United Kingdom ..... 38146/75

[51] Int. Cl.[2] ..... C11D 7/56

[52] U.S. Cl. ..... 252/99; 252/89 R; 252/95; 252/135; 252/525; 252/544; 252/DIG. 2; 252/DIG. 15; 252/380; 252/384; 8/137

[58] Field of Search ..... 252/95, 99, 89, 135, 252/525, 544, DIG. 2, DIG. 15, 380, 81, 383, 84, 8.6; 8/137, 142

[56] References Cited

U.S. PATENT DOCUMENTS 4,013,594 3/1977 Froehlich et al. ..... 252/DIG. 2

FOREIGN PATENT DOCUMENTS 2218381 9/1974 France ..... 252/DIG. 2

1429911 3/1976 United Kingdom ..... 252/DIG. 2

*Primary Examiner*—Mayer Weinblatt

*Attorney, Agent, or Firm*—Wenderoth, Lind & Ponack

[57] ABSTRACT

There are provided detergent compositions with improved flow characteristics which contain a highly-dispersed solid water-insoluble organic polymer, e.g. polycondensed aminoplasts such as urea-formaldehyde or melamine-formaldehyde polycondensation products as well as vinyl polymers such as polyacrylpolymers. In particular the detergent compositions comprise (a) 0 to 50% of an non-ionic synthetic surfactant (b) 50 to 80% of a builder (c) 0 to 25% of an anionic surfactant (d) 0.01 to 2.5% of the highly dispersed polymer, with the proviso that at least 5% of either a non-ionic or an anionic surfactant is present in the composition, the % being based on the weight of total finished detergent.

9 Claims, No Drawings

DETERGENT COMPOSITIONS

The present invention relates to newly-introduced solid detergent compositions in which the surfactant content is based essentially on nonionic synthetic surfactants with short ethoxylate chains, or an anionic synthetic or natural surfactants together with the usual builders, bleaching agents, extenders and other optional components.

These newly-introduced solid detergent compositions are slightly sticky and oily in aspect, giving rise to flow problems in manufacture, packaging and end-use.

We have found that the addition of a highly-dispersed solid, water-insoluble organic polymer (described hereafter) improves the flow properties, reduces oiling out in the package during storage, slightly increases the bulk density and does not adversely affect the performance of the finished detergent composition.

According to the present invention, there is provided a detergent composition comprising:

(a) 0 to 50% by weight of a non-ionic synthetic surfactant
(b) 50 to 80% by weight of builders and extenders
(c) 0 to 25% by weight of an anionic surfactant, and
(d) 0.01 to 2.5% by weight of a highly-dispersed, solid water-insoluble organic polymer, each of the percentages being based on total finished detergent, with the proviso that at least 5% by weight of either a non-ionic or an anionic surfactant are present in the detergent composition.

Preferably, the detergent composition comprises:

(a) 5 to 50% by weight of a non-ionic synthetic surfactant
(b) 50 to 80% by weight of builders and extenders
(c) 0 to 25% by weight of an anionic surfactant, and
(d) 0.01 to 2.5% preferably 1 to 2% by weight of a highly-dispersed, solid water-insoluble organic polymer.

The non-ionic synthetic surfactant i.e. component (a) of the inventive compositions may fall within one of the following sub-groups:

monoethers of polyglycols with long-chain fatty alcohols. For instance, the condensation products of 5 to 20 moles of ethylene oxide and 1 mole of a fatty alcohol having 10 to 18 carbon atoms e.g. cetyl alcohol.

monoesters of polyglycols with long-chain fatty acids. For instance, the condensation products of 5 to 20 moles of ethylene oxide and 1 mole of a fatty acid having 10 to 18 carbon atoms, for example stearic acid.

monoethers of polyglycols with alkyl-phenols. For instance, the reaction products of 5 to 20 moles of ethylene oxide and 1 mole of a phenol substituted by an alkyl group having 6 to 12 carbon atoms e.g. nonyl phenol.

N,N-polyethoxylated long-chain fatty amines. For instance, the reaction products of 5 to 50 moles of ethylene oxide and 1 mole of a fatty amine having 12 to 18 carbon atoms e.g. cocoamine and tallow amine.

N,N-polyethoxylated long-chain fatty acid amides. For instance, the reaction products of 5 to 50 moles of ethylene oxide and 1 mole of a hydrogenated fatty amide having 12 to 18 carbon atoms e.g. hydrogenated tallow amide.

Mixtures thereof are also suitable as component (a).

Suitable builders which can form part of component (b) of the compositions of this invention include one or more of water soluble alkali metal salts e.g. carbonates, borates, phosphates, polyphosphates, bicarbonates and silicates. Examples of such salts are sodium carbonate, sodium tetraborate, sodium pyrophosphate, sodium polyphosphate, potassium polyphosphate, sodium bicarbonate and sodium silicate. Other suitable builders are watersoluble alkali metal or ammonium sequestrant salts e.g. sodium, potassium and ammonium ethylene diamine tetraacetates. The builder component (b) often includes a bleaching agent such as alkali metal per-carbonates and per-sulphates, more usually alkali metal per-borates.

Suitable extenders for use in the detergent compositions of the present invention are inert inorganic salts such as alkali salts of strong acids e.g. sodium chloride and sodium sulphate.

The anionic surfactants suitable for use as component (c) in the inventive compositions may be natural surfactants, in particular soaps, or synthetic surfactants. Examples of natural or synthetic surfactants are alkali metal or ammonium salts of fatty carboxylates, sulphates or sulphonates and alkali metal alkane sulphonate or alkali metal $\alpha$-olefin sulphonate. Specific examples are alkali metal stearates, alkali metal alkyl sulphates e.g. sodium dodecyl sulphate, alkali metal alkyl sulphonates e.g. potassium dodecyl sulphonate, alkali metal alkaryl sulphonates e.g. sodium dodecyl benzene sulphonate, fatty acid sarcosinates, sulphonated alkyl esters of long chain fatty acids and alkyl sulphosuccinates.

Component (d) of the composition of the present invention is preferably a highly-dispersed solid polymer having a molecular weight greater than 1000 and a specific surface area greater than $5m^2/g$, consisting preferably of micro particles in the micron or submicron range. Such polymers are described in British Pat. No. 1,323,890. These highly dispersed polymers may be linear or branched and may be built up by polymerisation, polycondensation or polyaddition reactions or by a combination of such reactions. Examples of such polymers are polycondensation products, especially polycondensed aminoplasts such as urea-formaldehyde and melamine-formaldehyde polymers as well as vinyl polymers such as polyacrylnitrile.

The production of said highly-dispersed solid polymers is more fully described in British Pat. Specifications Nos. 1,043,437, 1,071,307, 1,239,143, 1,296,246, 1,318,244 and 1,355,367 and in "Makromolekulare Chemie" 120, 68–86 (1968) and 149, 1–27 (1971).

The preferred solid polymers used according to the invention are condensation polymers from urea and formaldehyde which normally contain virtually no inorganic substances.

The primary particles, which are almost spherical, generally have a diameter of 0.1 $\mu$ or less. They are agglomerated to particles with a diameter of 3 to 6 $\mu$, preferably 4 to 6 $\mu$.

The size and shape of the agglomerated particles cannot be attained by mechanical processes, but is the result of a polycondensation which is carried out under the special conditions as disclosed in the British Patents mentioned above.

Urea/formaldehyde condensation products which have been manufactured in the presence of sulphamic acid or an ammonium hydrogenate sulphate have proved particularly advantageous.

These condensation products are characterised by their large specific surface area, which is desirably 15 to 30 $m^2/g$.

The urea/formaldehyde condensation products are manufactured e.g. by converting the aqueous solution of a precondensate of urea and formaldehyde, optionally in the presence of a protective colloid, into a gel by addition of sulphamic acid or of a water-soluble ammonium hydrogenate sulphate of the formula $$[R - NH_3]^{\oplus} [SO_4H]^{\ominus}, \quad (1)$$

wherein R represents hydrogen or an organic radical that does not impair the water solubility, e.g. in particular alkyl, cycloalkyl, hydroxyalkyl, aralkyl or aryl, the molar ratio of formaldehyde to urea at the moment of the gel formation at the latest being greater than 1, and comminuting, drying and deagglomerating the resultant gel.

If protective colloid is used, then the molar ratio of formaldehyde to urea is desirably greater than 1.2.

Further optional components of the detergent compositions of the invention are foam stabilisers, dirt-suspending agents, optical brightening agents, enzymes and mild perfumes.

Suitable foam stabilisers are long chain alkanolamides e.g. coconut monoethanolamide. A suitable dirt-suspending agent is carboxymethyl cellulose. As optical brighteners there may be used these following types: triazinyl-diamino-stilbene disulphonic acids, aminocoumarins, pyrazolines, stilbyl naphthatriazoles, imidazolones, benzidine sulphone bisoxazoles, distyryl diphenyls, dibenzimidazoles or derivatives thereof. Enzymes which may conveniently be used are those containing predominately a protease produced from a spore-forming *Bacillus subtilis* bacterium. A suitable perfume is one having a citrus, cologne or pine base.

The present invention also provides a method for the manufacture of a detergent composition showing an improved flowability which comprises blending the aforesaid components (a), (b), (c) and from 0.01–2.5% by weight of a highly-dispersed, solid, water-insoluble organic polymer as component (d).

The method of the present invention may, for instance, be carried out by dry-blending component (d) with components (a), (b) and (c), in any desired sequence of addition. Alternatively, the component (d) may be added to an aqueous slurry of components (a), (b) and (c) prior to the spray-drying of the combined whole, whereby possible losses of e.g. component (a) may be reduced during the subsequent drying step.

The detergent compositions of the present invention exhibit improved flow properties when compared with commercial detergent compositions based on non-ionic or anionic surfactants and foam stabilisers, and these improved flow properties are not significantly affected by the ambient humidity. Moreover, the detergent compositions of the present invention compare favourably with the said commercial detergents in terms of fluorescent whitening performance, detergency, soil anti-redeposition, bleaching efficiency and chalking i.e. deposition of flow improver on dark-coloured fabrics in the wash.

The following Examples further illustrate the present invention. Parts and percentages shown therein are by weight.

EXAMPLES 1 to 8

Various separate samples of a commercially-available detergent powder (Detergent A) based on non-ionic surfactants and non-ionic long-chain alkanolamides as foam stabilisers are mixed with a commercially-available urea/formaldehyde condensation product (Product A) in the following proportions: nil %, 0.05%, 0.1%, 0.25%, 0.5%, 1.0%, 1.5%, 2.5% and 5.0%.

Product A has the following characteristics:
- diameter of the primary particles: 0.1 microns
- diameter of the agglomerates of these particles: 4 to 6 microns
- specific surface area of the particles: 20 $m^2/g$
- specific weight: 1.45 $g/cm^3$ The mixing is carried out in a fibre keg on a roller miller over a period of 18 hours. Each sample is then divided between two large washing powder packets and stored at 20° C./65% relative humidity (r.h.) and 20° C./93% r.h., respectively, each over a period of 36 hours.

(a) Effect on flowability

The flow characteristics are assessed by filling a large-size washing powder packet 6.75 × 10.0 × 17.8 cm to a point 6.35 cm from the top of the packet to give an average packet content of 380 g. The % pour is then measured at various angles.

Each sample is tested twice by the following procedure:
- Invert the packet twice to loosen any powder aggregates.
- Place in the test apparatus and rotate through the required angle, collecting powder which pours out over 30 seconds.
- Weigh the powder poured out.

The results of these are summarized in Table I.

TABLE I

| Example | Product A content of sample in % | Stored at 65% r.h. % pour at 100° | 110° | 120° | Stored at 93% r.h % pour at 100° | 110° | 120° |
|---|---|---|---|---|---|---|---|
| — | nil | 8.0 | 31.7 | 76.0 | 13.7 | 32.7 | 77.2 |
| 1 | 0.05 | 12.6 | 28.8 | 71.5 | 11.7 | 31.7 | 78.3 |
| 2 | 0.1 | 8.6 | 31.3 | 74.9 | 12.9 | 30.4 | 84.4 |
| 3 | 0.25 | 11.0 | 29.7 | 75.9 | 13.6 | 37.2 | 79.6 |
| 4 | 0.5 | 12.6 | 40.2 | 84.4 | 13.0 | 42.1 | 83.2 |
| 5 | 1.0 | 12.5 | 42.6 | 87.9 | 16.6 | 42.8 | 91.4 |
| 6 | 1.5 | 14.8 | 42.4 | 93.3 | 17.4 | 46.1 | 96.6 |
| 7 | 2.5 | 14.6 | 36.3 | 85.3 | 16.6 | 41.6 | 91.2 |
| 8 | 5.0 | 9.0 | 26.3 | 74.7 | 8.9 | 27.2 | 54.6 |

These show that the optimum dosage of Product A is 1.5%, and that humidity does not significantly affect the flow characteristics except at high dosages of e.g. 5% of Product A where % pour is reduced at 120°.

(b) Effect on fluorescent whitening agent (f.w.a.) performance

The f.w.a. performance of the commercially-available non-ionic detergent containing no Product A was compared with that of a detergent composition of the present invention under the following conditions:
- Substrate: mercerised cotton sateen free from f.w.a.
- Temperature: 60° C.
- Time of wash: 15 minutes each
- Liquor ratio: 20:1
- Liquor: preheated water to which 5 g/l detergent sample was added as a powder immediately prior to washing the pattern
- Illustration: after 1, 5 and 10 successive washes After thorough rinsing, drying and "conditioning" at 20° C./65% r.h., the total fluorescent $F_2$ of each pattern was measured on a Harrison Colorimeter, Model 61, filter 2 (U-V-illuminant), taking an average of ten readings from the sateen face of the doubled pattern as the result in each case. The patterns were also assessed visually against the CIBA-GEIGY Fabric White Scale (WS), Issued in 1973 (also see "Ciba-Geigy Rundschau", 1973/1, page 12).

This scale is made up of 18 pieces of cotton fabric treated with fluorescent whitening agents which form a series of optically equidistant steps numbered in tens from 70–240.

70 corresponds to the white of a cotton fabric given a full chemical bleach but not treated with a fluorescent whitener. 240 corresponds to a very intense white attainable with fluorescent whitening agents.

Specimens whose white differs in shade from that of the White Scales are more difficult to assess. The difference in shade can be indicated by adding to the numerical rating whichever of the following suffixes is appropriate:

G1 = trace greener than scale
G2 = slightly greener than scale
G3 = appreciably greener than scale
R1 = trace redder or more violet than scale
R2 = slightly redder or more violet than scale
R3 = appreciably redder or more violet than scale The results are as follows:

| | After 1 wash | | After 5 washes | | After 10 washes | |
|---|---|---|---|---|---|---|
| Sample | $F_2$ | WS | $F_2$ | WS | $F_2$ | WS |
| no Product A | 310 | 190 | 459 | 240 G1 | 492 | 420 G2 |
| 1.5% Product A | 308 | 190 | 459 | 240 G1 | 494 | 240 G2 |

These results show that the f.w.a. performance of the commercially available non-ionic detergent is unaffected by the addition of 1.5% of Product A.

(c) Effect on detergency and soil anti-redeposition properties

The detergency and soil anti-redeposition properties of the commercially-available non-ionic detergent containing 1.5% of Product A are compared with those of the detergent containing no Product A under the following conditions:

Substrate:
EMPA 101 soiled cotton and clean cotton poplin free from f.w.a.
EMPA 101 fabric is supplied by: EIDGENOESSISCHE MATERIALPRUEFUNGS- UND VERSUCHSANSTALT, Switzerland Temperature: 60° C.
Time of wash: 30 minutes
Liquor ratio: 20:1
Liquor: preheated water to which 5 g/l detergent sample was added as a powder immediately prior to washing the patterns The treated patterns are thoroughly rinsed and dried, and the whiteness of each pattern is measured on a Hunterlab D25 Color Difference Meter, taking an average of four readings (two pairs at 90° to one another) as the result in each case for L, a and b. L is the total luminosity and a and b indicate the position in terms of colour coordinates (also see "Ciba-Geigy Rundschau", 1973/1, page 18). Comparison of these values with those taken before treatment give differences representing detergency (loss of grey from EMPA 101) and soil anti-redeposition (pick-up of grey on clean cotton poplin).

The results are as follows:

a. Detergency

| Sample | W* (before washing) | W* (after washing) | ΔW |
|---|---|---|---|
| no Product A | 34.872 | 55.463 | +20.591 |
| 1.5% Product A | 34.575 | 56.056 | +21.481 |

b. Soil anti-redeposition

| Sample | W* (before washing) | W* (after washing) | ΔW |
|---|---|---|---|
| no Product A | 74.708 | 73.480 | −1.222 |
| 1.5% Product A | 74.754 | 73.769 | −0.985 |

$$*W = 100 - \sqrt{(100 - L)^2 + 2.25\,(a^2 + b^2)}$$

A difference in ΔW of 0.5 is perceptible to a trained observer

These results show that the detergency and soil anti-redeposition properties of the commercial detergent are not adversely affected by the addition of 1.5% of Product A.

(d) Effect on bleaching efficiency

The bleaching efficiency of the commercial non-ionic detergent containing 1.5% of Product A was compared with the detergent containing no Product A under the following conditions:

Substrate : tea-stained cotton poplin

The tea-stained fabric was prepared in the following manner:

Extract 20 g leaf tea for 1 hour in 800 ml water at 100° C. Filter off the solution under vacuum and re-extract the residue in 200 ml water for a further one-half hour at 100° C. Filter off as before, add the filtrate to the original filtrate and make up the total volume to 1000 ml.

Prepare 9 patterns of mercerised cotton poplin (suitable fabric has a weight per unit area of 190 grams/m²) free from f.w.a., each weighing 5 grams. Treat them with the tea extract in enclosed dyeing vessels for 2½ hours at 100° C., liquor ratio 24:1.

Leave to stand in the dark for 17 hours, ensuring that all the fabric is totally immersed in the extract.

Re-heat to 100° C. and treat for a further 2½ hours at this temperature.

Rinse in water at 70° C., and dry at 100° C. for 20 hours to "age" the stain.

Remove loose stain by washing in 5 g/l f.w.a.-free synthetic anionic detergent without bleaching agents at 90° C. for 20 minutes, liquor ratio 20:1, followed by rinsing, and drying at 70° C.

Temperature: 60° C.
Time of wash: 15 minutes
Liquor ratio: 20:1
Liquor: preheated water to which 5 g/l detergent sample was added as a powder immediately prior to washing the pattern The treated patterns are thoroughly rinsed and dried, and the whiteness of each pattern is measured on a Hunterlab D25 Color Difference Meter, taking an average of eight readings (four pairs at 90° to one another) as the result in each case for L, a and b.

Comparison of these values with those taken before treatment, and that of clean cotton poplin, give the following bleaching efficiencies:

| Sample | W (before washing) | W (after washing) | bleaching efficiency** |
|---|---|---|---|
| no Product A | 69.506 | 75.594 | 31.15% |
| 1.5% Product A | 70.035 | 76.557 | 34.30% |

-continued

| Sample | W (before washing) | W (after washing) | bleaching efficiency** |
|---|---|---|---|
| (clean cotton poplin 89.050) | | | |

** Bleaching efficiency $= \frac{W\text{ (after washing)} - W\text{ (before washing)}}{W\text{ (clean cotton)} - W\text{ (before washing)}} \times 100\%$ These results show that the bleaching efficiency of the commercial non-ionic detergent is slightly improved by virtue of the addition of 1.5% of Product A.

(e) Effect on dark-coloured fabrics in the wash

The effect on dark-coloured fabrics of the commercial non-ionic detergent containing 1.5% of Product A was compared with that of the detergent containing no Product A under the following conditions:

Substrate: navy-blue cotton lawn and dark blue polyamide 6 Celon

Temperature: 60° C.

Time of wash: 15 minutes

Liquor ratio: 20:1

Liquor: preheated water to which 5 g/l detergent sample was added as a powder immediately prior to washing the pattern Illustration : after 1 and 5 successive washes The treated patterns are lightly rinsed and dried, and compared visually for presence of "chalking" due to deposition of Product A.

The results of these examinations on both fabrics show that addition of 1.5% Product A does not cause "chalking" of the washed fabric.

(f) Effect on bulk density of the powder

The bulk densities of samples of powder containing 0%, 1.5% and 2.5% of Product A are determined using the Radon automatic compaction density unit, Type No. LE/A/DU-14, which conforms to B.S. 1460.

A portion of sample, weighing 20 g, is placed in a 150 ml glass cylinder as supplied with the compaction unit. The cylinder is fitted into the unit and "dropped" 50 times, after which the volume of the compacted powder is noted.

The results were as follows:

| Content of Product A | Bulk density (g/ml) |
|---|---|
| 0% | 0.51 |
| 1.5% | 0.53 |
| 2.5% | 0.56 |

These results show that the bulk density of the finished powder is slightly increased by addition of Product A, amounting to approx. 4% increase at the optimum addition of 1.5% Product A.

(g) Effect on oiling out of the powder during storage

Typical washing powder packets, made from white-lined chip board, 550μ thick, weighing 340g/m$^2$ are filled with samples of the powder containing 0% and 1.5% of Product A and stored in the laboratory for eight weeks. The packets are then examined visually for oiliness shown on the outside face of each packet, this being rated according to the following scale:

0 = no marking
1 = trace
2 = slight
3 = moderate
4 = substantial

The results were as follows:

| Content of Product A | Outside of packet |
|---|---|
| 0% | 3 |
| 1.5% | 1 |

These results show that addition of 1.5% of Product A to the detergent composition reduces its tendency to oil out during storage.

EXAMPLES 9 to 32

Built detergent powders are prepared to contain the following surfactants:

Surfactant A:

100% of a non-ionic surfactant consisting of a C12/C13 fatty alcohol ethoxylated with a mean of 6 moles ethylene oxide.

Surfactant B:

75% of the non-ionic surfactant A. 25% of an anionic surfactant consisting of a sodium alkane sulphonate.

Surfactant C:

100% of a non-ionic surfactant consisting of a coconut fatty amine ethoxylated with a mean of 15 moles ethylene oxide.

Surfactant D:

100% by weight of an anionic surfactant consisting of a sodium alkane sulphonate Built detergent powders are prepared from one of these surfactant components by adding a builder selected from sodium tripolyphosphate, sodium carbonate and natural sodium aluminosilicate; adding an extender (sodium sulphate), mixed as a slurry, vacuum-dried and ground; and finally adding sodium perborate and, where appropriate, Product A, as a final dry-mix.

The actual compositions of the respective built detergent powders so produced are set out in Table II.

The percentage pour test is then carried out on each of the detergent powders using the method described in Examples 1 to 8. The results of the tests are shown in Table III.

TABLE II

| Components of detergent powder | constitution of model detergent powders | | | of the composition as indicated above and that the optimum dosage of Product A is 1.5%.

What is claimed is:

1. A detergent composition consisting essentially of
(a) 0 to 50% by weight of a non-ionic synthetic surfactant selected from the group consisting of
(1) monoethers of polyglycols with long-chain fatty alcohols,
(2) monoesters of polyglycols with long-chain fatty acids,
(3) monoethers of polyglycols with alkylphenols,
(4) N,N-polyethoxylated long-chain fatty amines,
(5) N,N-polyethoxylated long-chain fatty acid amides, and
(6) mixtures thereof,
(b) 50 to 80% by weight of water-soluble builder and extender
(c) 0 to 25% by weight of a water-soluble anionic surfactant and
(d) 0.01 to 2.5% by weight of a highly-dispersed, solid, water-insoluble urea-formaldehyde condensation product having a molecular weight greater than 1000 and a specific surface area of 15 to 30 $m^2/g$, said condensation product being one which is produced in the presence of sulphamic acid each of the percentages being based on total finished detergent, with the proviso that at least 5% by weigh of either a non-ionic or an anionic surfactant is present in the detergent composition.

2. A detergent composition according to claim 1 containing 5 to 50% by weight of the non-ionic synthetic surfactant as component (a).

3. A detergent composition according to claim 1 containing 1 to 2% by weight of the urea-formaldehyde condensation product as component (b).

4. A detergent composition according to claim 1 in which a condensation product of 5 to 20 mols of ethylene oxide and one mol of a fatty alcohol or fatty acid having 10 to 18 carbon atoms, a condensation product of 5 to 20 mols of ethylene oxide and 1 mol of a phenol substituted by an alkyl group having 6 to 12 carbon atoms, or a condensation product or 5 to 50 mols of ethylene oxide and one mol of a fatty amine or a hydrogenated fatty amide having 12 to 18 carbon atoms is used as component (a).

5. A composition according to claim 1 in which a water-soluble alkali metal carbonate, borate, phosphate, polyphosphate, bicarbonate or silicate is used as component (b).

6. A composition according to claim 1 in which component (b) includes an alkali metal per-borate as a bleaching agent.

7. A composition according to claim 1 in which an inert, inorganic alkali salt of a strong acid is used as component (b).

8. A composition according to claim 1 in which an alkali metal or ammonium salt of a fatty carboxylate is used as component (c).

9. A composition according to claim 1 in which the urea-formaldehyde condensation product consists of agglomerates with a diameter of 3 to 6 microns.

* * * * *